United States Patent [19]

Beling

[11] 4,302,701

[45] Nov. 24, 1981

[54] DIRECTLY HEATED CATHODE FOR AN ELECTRON TUBE WITH COAXIAL ELECTRODE DESIGN

[75] Inventor: Ingo Beling, Berlin, Fed. Rep. of Germany

[73] Assignee: Siemens Aktiengesellschaft, Berlin & Munich, Fed. Rep. of Germany

[21] Appl. No.: 69,868

[22] Filed: Aug. 27, 1979

[30] Foreign Application Priority Data

Aug. 31, 1978 [DE] Fed. Rep. of Germany ..... 2830020

[51] Int. Cl.[3] ..... H01J 1/46; H01J 21/10

[52] U.S. Cl. ..... 313/293; 313/299; 313/348

[58] Field of Search ..... 313/293, 346, 337, 348, 313/299

[56] References Cited

U.S. PATENT DOCUMENTS 3,591,822 7/1961 Katz ..... 313/355
3,826,948 7/1974 Polese et al. ..... 313/293
4,076,992 2/1978 Mark ..... 313/348
4,119,880 10/1978 Wilcox et al. ..... 313/348
4,178,530 12/1979 Lersmacher et al. ..... 313/346

*Primary Examiner*—Saxfield Chatmon, Jr.
*Attorney, Agent, or Firm*—Hill, Van Santen, Steadman, Chiara & Simpson

[57] ABSTRACT

In an exemplary embodiment, a transmitting tube has a coaxial design of the electrodes and their lead-ins and includes a cathode formed of a hollow cylinder which is secured at one end to an annular cathode lead, and at the other end is secured to a cathode cap which is supported at a power supply lead extending coaxially within the hollow cylinder. In this cathode, the carrier is not to consist of wire, so that inhomogeneities on the cathode surface are avoided. To this end, the disclosure provides that the hollow cylinder consist of pyrolytic graphite and be coated with a thin metal layer, preferably consisting of tungsten carbide and thorium, or a thorium oxide.

4 Claims, 1 Drawing Figure

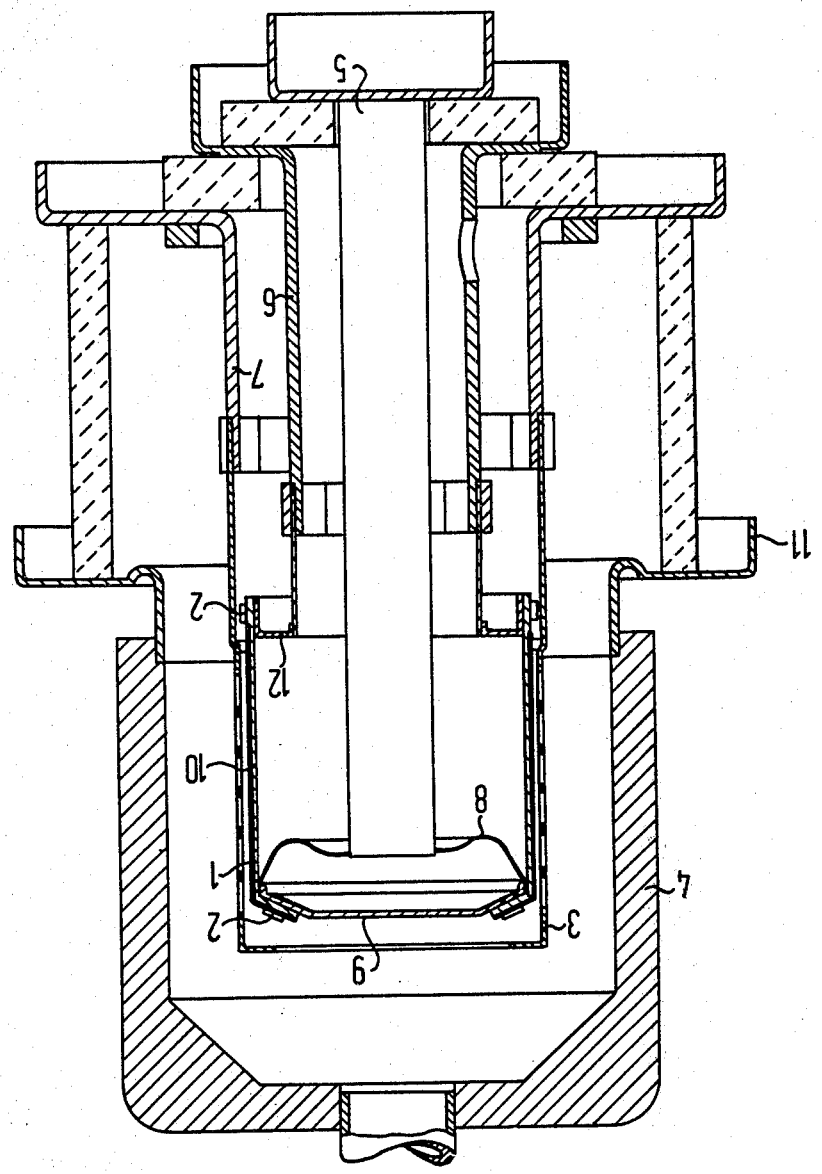
5
6
7
11
2
12
10
8
1
2
3
4
9

DIRECTLY HEATED CATHODE FOR AN ELECTRON TUBE WITH COAXIAL ELECTRODE DESIGN

BACKGROUND OF THE INVENTION

The invention relates to a directly heated cathode for electron tubes, particularly transmitting tubes, with coaxial design of the electrodes and their lead-ins, which cathode exhibits a hollow cylinder which is secured at one end to an annular cathode lead, and at the other end is secured to a cathode cap which is mounted at a power supply lead extending coaxially in the hollow cylinder.

Such a cathode is known, for example, from the German AS No. 24 15 384. It further proceeds as known from this German AS that one uses tungsten wire as carrier for the manufacture of cathodes which are directly heated and exhibit a metal film as the emission layer, for example tungsten carbide with thorium film. The required surface and mechanical stability is achieved by means of an appropriate arrangement of the wires, in mesh or needle form in transmitting tubes. An inhomogeneous cathode surface which has effects on the electrode system follows of necessity from the design of the cathodes. There are also difficulties in the manufacture of cathodes with narrow wire intervals. In transmitting tubes with narrow grid-cathode intervals and meshed cathodes, the different intervals (outer wire and inner wire of the meshed cathode) have a deleterious effect on the electrical performance of the electron tubes.

Cathodes with a homogeneous surface are known up to now only as oxide matrix or dispenser cathodes. Specific operating relationships of electron tubes, particularly transmitting tubes of greater output, forbid the employment of such cathodes.

SUMMARY OF THE INVENTION

The object of the invention is therefore to create a directly heated cathode whose carrier does not consist of wire so that inhomogeneities on the cathode surface are avoided. For achieving this object, it is inventively proposed in a directly heated cathode for electron tubes, particularly transmitting tubes, of the type initially cited that the hollow cylinder consist of pyrolytic graphite and be covered with a thin metal layer as emission layer. In this case the thin metal layer preferably consists of tungsten carbide and thorium, or a thorium oxide.

It is known per se to manufacture lattice electrodes for electron tubes of a pyrolytic graphite (cf., for example, the German AS No. 1 194 988 or, respectively, the German AS No. 1 639 168). Thus, cylinders, plates, rings or discs of a pyrolytic graphite can be manufactured. This graphite has the advantages that it tolerates high temperatures and is well suited as the raw material for vacuum parts.

The thin metal or metallic layer about 0.03 to 0.04 mm thick (cathode layer) consisting, preferably, of tungsten carbide and thorium, thorium oxide, can be applied to the hollow cylinder of the cathode consisting of pyrolytic graphite about 0.2 to 1.0 mm thick in an advantageous manner by means of the following process. Either thorium-tungsten powder is cataphoretically deposited on the hollow cylinder as a thin metal layer and subsequently sintered on or a thin metal layer consisting of thorium and tungsten is vapor-deposited onto the hollow cylinder with the assistance of an electron beam. A further, expedient process consists in depositing thorium-tungsten from the gaseous phase as a thin metal layer on the hollow cylinder (carrier body) which is formed of pyrolytic graphite.

The inventive directly heated cathodes particularly have the following advantages in comparison to mesh cathodes. The stability of the cathodes as determined by the pyrolytic graphite is much greater at the operating temperatures in comparison to tungsten. Plate cathodes or lattice cathodes can be manufactured depending on the demands. A flattening of the cathode cylinder because of a longitudinal expansion upon switching on of the electron tube no longer occurs.

The invention is to be explained in the following with further features on the basis of the single FIGURE of the drawings; and other objects, features and advantages will be apparent from this detailed disclosure and from the appended claims. Parts which do not necessarily add to the understanding of the invention are left without reference symbols or are omitted.

BRIEF DESCRIPTION OF THE DRAWING

The single FIGURE is a somewhat diagrammatic longitudinal sectional view of an exemplary embodiment showing a transmitting triode with coaxially arranged cylindrical electrodes and lead-ins.

DETAILED DESCRIPTION

In the illustrated embodiment, there is shown a central, directly heated cathode which is connected with the lead-in plate or, respectively, inner cathode terminal ring 5 and the carrier tube 6 (outer cathode terminal). The hollow cylinder 1 of the cathode is surrounded first by the lattice electrode 3 and then by the anode 4 with the appertaining carrier tubes 7, 11. The actual discharge vessel beyond the anode 4 designed as external anode is essentially formed by the pass-through foot which, in standard metal-ceramic technology, is composed alternately of metal carrier tubes or discs and ceramic rings.

The cathode terminals 5, 6 secured to the stem respectively terminate in a cathode cap 9 and in an annular cathode lead 12 to which the actual hollow cylinder 1 of the cathode is secured. The respective cathode fixing devices are provided with the reference symbol 2. A flexible power supply lead 8 is secured to the cathode cap 9, which power supply lead 8 leads from the inner cathode terminal 5 to the hollow cylinder 1. The hollow cylinder 1 of the cathode consists of pyrolytic graphite and is coated with a thin metal layer 10, preferably consisting of tungsten carbide and thorium as an emission layer.

It will be apparent that many modifications and variations may be effected without departing from the scope of the novel concepts and teachings of the present invention.

I claim as my invention:

1. A directly heated cathode for electronic transmitting tubes with coaxial design of the electrodes and their lead-ins, said cathode comprising a hollow cylinder (1) arranged axially and having first and second axial ends, an annular cathode lead (6, 12) secured to the first axial end of the hollow cylinder (1), a cathode cap (9) secured to the second axial end of the hollow cylinder (1), a power supply lead (5) extending coaxially in the hollow cylinder (1) and being connected with said cathode cap (9), said cathode cap (9) being mounted at an inner axial end of said power supply lead (5), the hollow cylinder (1) being formed of pyrolytic graphite and being coated with a thin metallic layer (10) as emission layer, characterized in that the thin metallic layer (10) is of tungsten carbide and thorium.

2. A process for manufacturing a directly heated cathode according to claim 1, characterized in that thorium-tungsten powder is cataphoretically deposited as a thin metallic layer (10) on the hollow cylinder (1) and is subsequently sintered on.

3. A process for the manufacture of a directly heated cathode according to claim 1, characterized in that a thin metallic layer (10) of thorium and tungsten is vapor-deposited on the hollow cylinder (1) with the assistance of an electron beam.

4. A process for manufacturing a directly heated cathode according to claim 1, characterized in that thorium-tungsten is deposited on the hollow cylinder (1) as a thin metallic layer (10) from the gaseous phase.

* * * * *